US005894624A

United States Patent [19]

Fulenwider

[11] Patent Number: 5,894,624

[45] Date of Patent: Apr. 20, 1999

[54] PAINTER'S TOOL

[76] Inventor: Philip Fulenwider, 505 Magnolia Ave., Hanceville, Ala. 35077

[21] Appl. No.: 08/892,208

[22] Filed: Jul. 14, 1997

[51] Int. Cl.[6] ..... A47L 13/12; A46B 9/10

[52] U.S. Cl. ..... 15/111; 15/105; 7/105; 7/143; 7/151

[58] Field of Search ..... 15/105, 106, 111, 15/184; 7/105, 143, 151

[56] References Cited

U.S. PATENT DOCUMENTS

D. 117,933 12/1939 Manchester et al. .
D. 218,388 8/1970 Whitaker .
860,593 7/1907 Christensen .
1,082,952 12/1913 Hobbs ..... 7/143
1,776,443 9/1930 Martin ..... 15/111
2,528,128 10/1950 Forster ..... 7/143
2,533,838 12/1950 Ranft ..... 15/111
2,674,001 4/1954 Abrams et al. ..... 15/184
2,682,072 6/1954 Green ..... 15/111
3,562,826 2/1971 Vaughn .
5,351,350 10/1994 Johnson .

*Primary Examiner*—Terrence R. Till
*Attorney, Agent, or Firm*—Wm. Randall May

[57] ABSTRACT

A combination tool for use by painters is disclosed. The tool consists of a putty knife, a retractable dusting brush, a hammer, a lever tool and a nail extractor which are ergonomically positioned and designed into one compact device.

2 Claims, 2 Drawing Sheets

PAINTER'S TOOL

BACKGROUND OF THE INVENTION

This invention relates generally to multi-purpose tools and more specifically to an improved multiple function painter's tool which incorporates all the tools needed for the various job tasks required to be performed by professional or lay painters.

The work of a painter, commercial or otherwise, requires the use of a number of tools. For example, most painting jobs regularly require the painter to use a putty knife for scraping old paint or spreading putty, spackling compound or caulk; a dusting brush or cloth for removing paint chips, dust particles or debris caused by sanding operations associated with the surface area to be painted; a hammer for countersinking nails or other work surface protrusions and for resealing paint containers; a screw driver or other lever for prying open paint containers; and a nail extractor for removing hanger nails or other protruding hardware. A need exists for a device which combines the functions of all these tools into one, compact, ergonomic hand tool.

While other combination tools have attempted to incorporate some of the general features of the present invention, none of these prior art devices have attempted to combine all of the specific features of applicant's device into one, well designed, useful tool.

SUMMARY OF THE INVENTION

In view of the foregoing, it is a primary object of this invention to provide an improved painting tool which combines the functions of a putty knife, dusting brush, hammer, pry lever and nail extractor into one compact, ergonomic device.

According to an embodiment of the invention, a multi-purpose painter's tool comprises a slightly oversized putty knife having a blade and a partially hollowed out handle portion forming a sheath into which is slidably situated a retractable dusting brush. One side edge of the brush/sheath/handle end of the device bears a combination hammer and V-notched nail extractor. The base of the handle adjacent to the putty knife blade is notched so as to form a pry lever tool.

An advantage of the present invention is the relative ergonomic placement, position and combination of the various tools comprising the device.

Another advantage of the present invention is the provision of the retractable dusting brush which renders the device very compact and therefore easy to carry and use.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
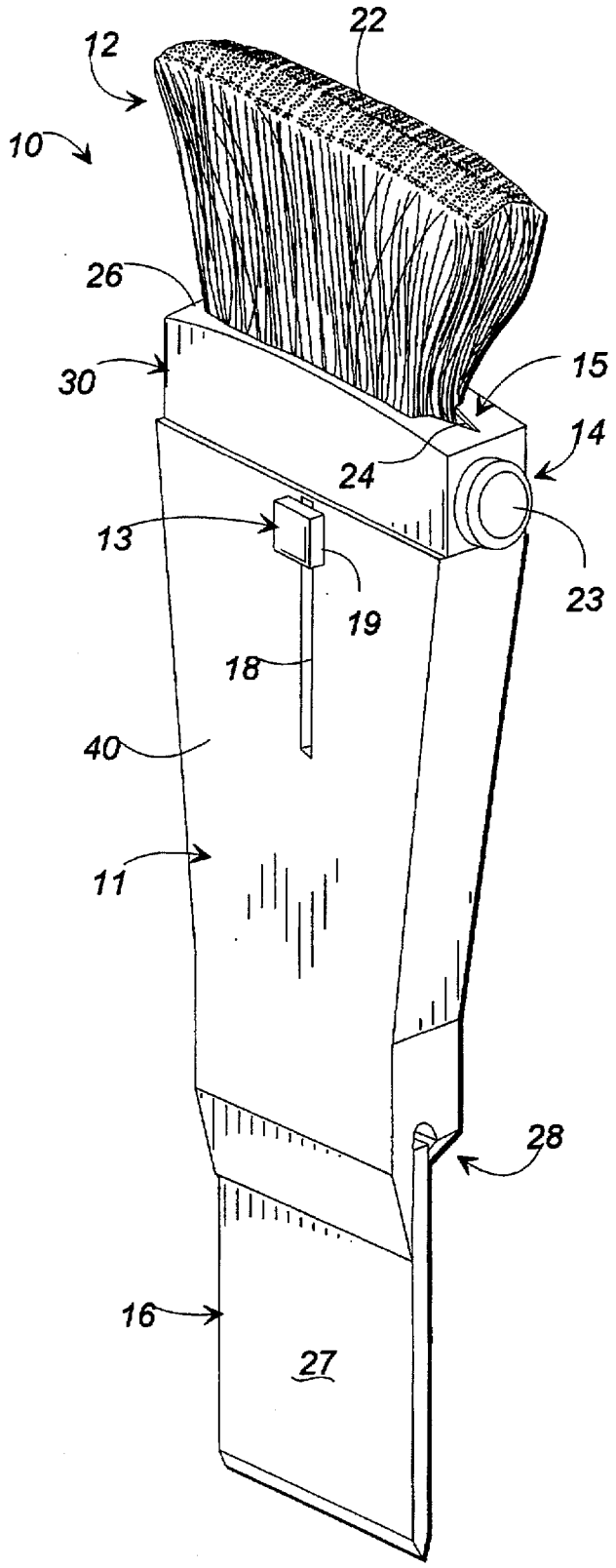
FIG. 1 is a perspective view of an embodiment of the invention shown with the dusting brush fully extended.
Figure 2:
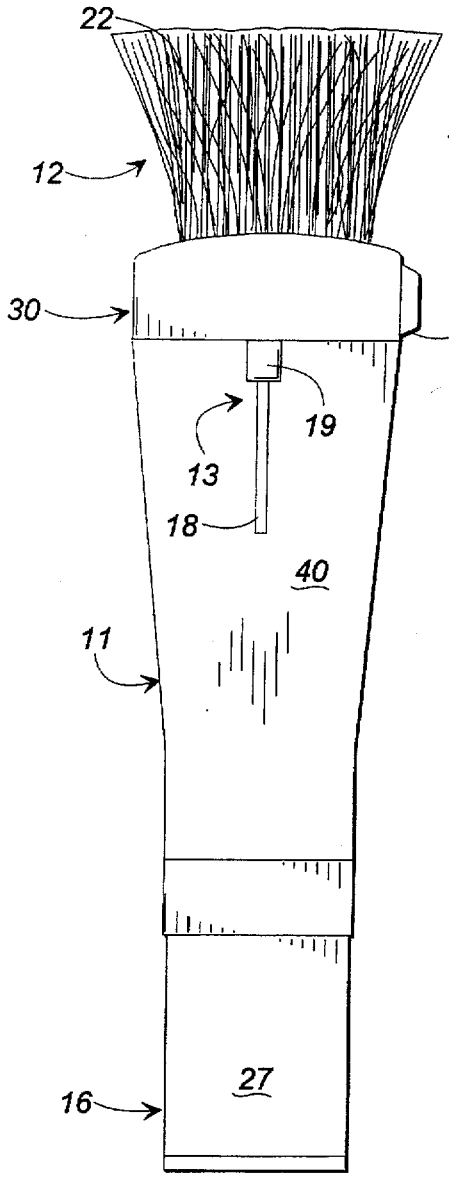
FIG. 2 is a front view of the embodiment of FIG. 1.
Figure 3:
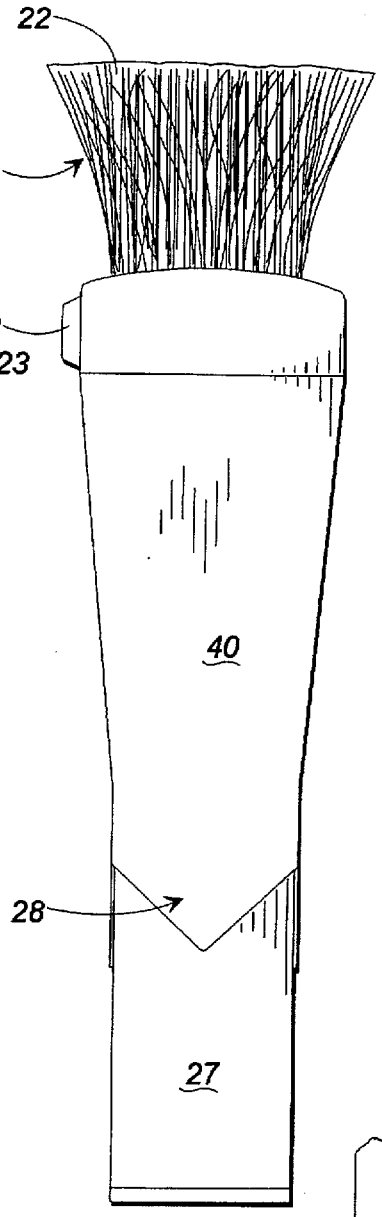
FIG. 3 is a rear view of the embodiment of FIG. 1.

In accordance with an embodiment of the invention, FIG. 1 shows a compact, multi-purpose painter's tool 10. The tool 10 of FIG. 1 comprises a generally wedge-shaped handle means 11 which incorporates a retractable brush means 12; a sliding actuator means 13; a hammer means 14; an extractor means 15; a lever means 28 and a scraper means 16.

The handle means 11 comprises a ferrule means 30 at one end and a handle body 40 having a hollow core section 17 thereby creating a sheath 25 for receiving the brush means 12. The ferrule means 30 is adjacent to, and extends from, said sheath 25 and has a lip 26 for the positioning of the extractor means 15. The ferrule means 30 also provides a surface for the attachment of the hammer means 14.

The brush means 12 can be slidably extended and retracted by the use of the actuator means 13 and comprises a plurality of bristles 22 which are rigidly attached at one end to a flexible bristle bar 20 slidably situated within the hollow core 17 of said handle means 11.

The actuator means 13 is slidably attached to one side of the handle means 11 at slot 18 and comprises an actuator tab 19 and a slide pin 21. The slide pin 21 extends from said actuator tab 19 through said slot 18 and is attached to the flexible bristle bar 20 of said brush means 12 at its midpoint. In order to extend the bristles 22 of the brush means 12, the actuator tab 19 is pushed forward along said slot 18 to a locked position. As the bristles 22 are being extended, the ends of the flexible bristle bar 20 are caused to encounter stops 31 located within the brush sheath 25 near the top of said sheath 25. Said stops 31 cause the flexible bristle bar 20 to bow outward thereby causing the brush bristles 22 to fan out into a wider configuration upon full extension of the bristles 22 as shown.

The hammer means 14 comprises a hammerhead 23 which is homogeneous with the ferrule means 30 and which is ergonomically positioned at one side edge of the handle means 11.

The extractor means 15 comprises a V-shaped notch 24 formed from the lip 26 of the ferrule means 30 of said handle means 11 and is situated at the top of said ferrule means 30 just above, and adjacent to, the hammer means 14.

Figure 4:
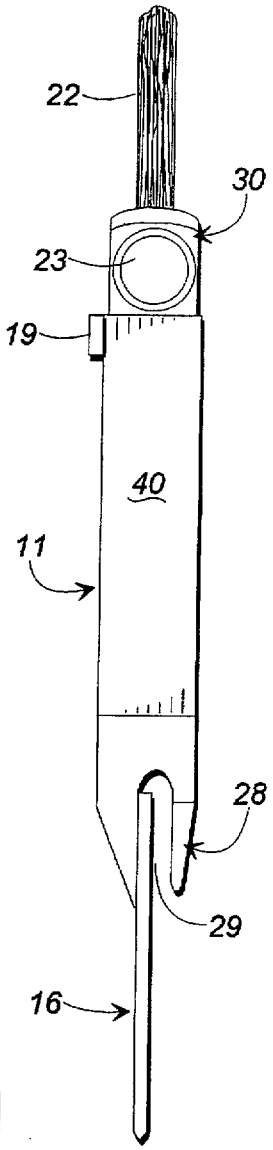
FIG. 4 is a right side view of the embodiment of FIG. 1.
Figure 5:
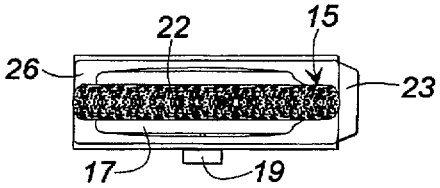
FIG. 5 is a top view of the embodiment of FIG. 1.
Figure 6:
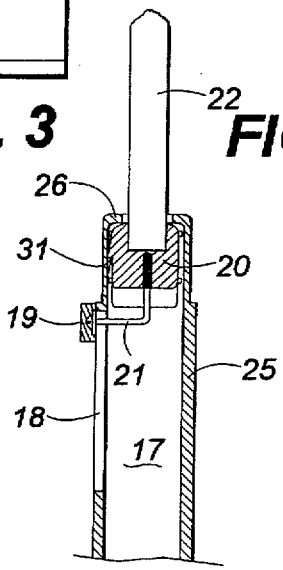
FIG. 6 is a partial sectional view of the embodiment of FIG. 1 showing the hollow core of the handle/sheath and the actuating means for the retractable dusting brush.

As shown in FIG. 4, the lever means 28 is formed at the base of said handle means 11 adjacent to the scraper means 16 and comprises a notched portion 29 of the handle means 11. Said notch 29 creates a gap between the base of the handle means 11 and the scraper means 16 and is of sufficient dimensions to allow the base of the handle means 11 to function as a pry tool for removing lids from paint containers.

The scraper means 16 comprises a standard size putty knife blade 27 which is rigidly attached to, and extends from, one end of the handle means 11.

The design and relative placement of the various tools of the device 10 create a tool which is very ergonomic and efficient to use and while the invention has been particularly shown and described with reference to the preferred embodiments thereof, it will be understood by those skilled in the art that various alterations in form, detail and construction may be made therein without departing from the spirit and scope of the invention.

The embodiments of the invention to which an exclusive property right or privilege is claimed are defined as follows:

1. A combination hand tool comprising:

a wedge shaped handle having a ferruled opening to a hollow cavity at one end and incorporating:

a retractable brush situated within said hollow cavity comprising a plurality of bristles rigidly attached at one end to a flexible bristle support bar;

a sliding actuator means for extending and retracting said brush wherein said actuator means is slidably attached to one side of said handle through a slot positioned longitudinally of the hollow cavity of said handle, said actuator means comprising a sliding actuator tab and a slide pin which extends from said actuator tab through said slot to the bristle support bar of said brush;

a hammer comprising a hammerhead which is homogeneous with said handle and is positioned on one side edge of said handle adjacent to said hollow cavity;

an extractor comprising a "V"-shaped notch formed at one end of the ferruled opening of said handle means and is situated adjacent to said hammer;

a blade positioned at, and rigidly attached to, a base of said handle and extending longitudinally therefrom; and, a lever formed at the base of said handle adjacent to said blade, said lever comprising a notched portion of said handle whereby said notch creates a gap between the base of said handle and said blade and is of sufficient dimensions to allow the base of said handle to function as a pry tool;

said handle further comprising stops within said hollow cavity for engaging the ends of said bristle support bar of said brush.

2. The apparatus of claim 1, wherein said blade is of sufficient dimensions to function as a putty knife.

* * * * *